US010656563B2

(12) United States Patent
Cohen et al.

(10) Patent No.: US 10,656,563 B2
(45) Date of Patent: May 19, 2020

(54) TRANSFERRING PRINT AGENT IN PRINT APPARATUS

(71) Applicant: HP Indigo B.V., Amstelveen (NL)

(72) Inventors: Orly Cohen, Ness Ziona (IL); Roni Yehuda, Ness Ziona (IL); Yoav Nachmias, Ness Ziona (IL); Dmitry Maister, Ness Ziona (IL); Michel Assenheimer, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/343,803

(22) PCT Filed: Oct. 25, 2016

(86) PCT No.: PCT/EP2016/075602
§ 371 (c)(1),
(2) Date: Apr. 22, 2019

(87) PCT Pub. No.: WO2018/077380
PCT Pub. Date: May 3, 2018

(65) Prior Publication Data

US 2019/0265614 A1 Aug. 29, 2019

(51) Int. Cl.
*G03G 15/10* (2006.01)
*G03G 15/16* (2006.01)
(Continued)

(52) U.S. Cl.
CPC ..... *G03G 15/105* (2013.01); *B41J 2/175* (2013.01); *B41J 2/17546* (2013.01);
(Continued)

(58) Field of Classification Search
CPC .... G03G 15/10; G03G 15/105; G03G 15/161; G03G 2215/0658; G03G 15/0855;
(Continued)

(56) References Cited

U.S. PATENT DOCUMENTS

2002/0171706 A1 11/2002 Miyamoto et al.
2010/0192792 A1 8/2010 Hall et al.
(Continued)

FOREIGN PATENT DOCUMENTS

CN 202088657 U 12/2011
CN 103625108 B 4/2015
(Continued)

OTHER PUBLICATIONS

Add Sparkle and Shine with Xerox® Specialty Dry Inks < https://www.xerox.com/digital-printing/clear-dry-ink/enus.html >.

*Primary Examiner* — Ryan D Walsh
(74) *Attorney, Agent, or Firm* — HP Inc. Patent Department

(57) ABSTRACT

In one example of the disclosure, it is determined that an amount of print agent remaining in a print agent container of a print apparatus is below a threshold level. An amount of print solution is transferred from a print solution reservoir of the print apparatus, or an amount of print solution solvent is transferred from a solvent reservoir of the print apparatus, into the print agent container. At least some of the remaining print agent is caused to dissolve into the amount of print solution or print solution solvent to forma rinse solution. The rinse solution is transferred from the print agent reservoir to the print solution reservoir.

13 Claims, 5 Drawing Sheets

(51) Int. Cl.

| | |
|---|---|
| ***B41J 2/175*** | (2006.01) |
| ***G03G 15/08*** | (2006.01) |
| ***G03G 15/00*** | (2006.01) |
| ***B41J 2/19*** | (2006.01) |

(52) U.S. Cl.
CPC ..... *B41J 2/17566* (2013.01); *B41J 2/19* (2013.01); *G03G 15/0855* (2013.01); *G03G 15/0862* (2013.01); *G03G 15/10* (2013.01); *G03G 15/104* (2013.01); *G03G 15/161* (2013.01); *G03G 15/553* (2013.01); *G03G 2215/0658* (2013.01)

(58) Field of Classification Search
CPC ..... G03G 15/0862; G03G 15/104; G03G 15/553; B41J 2/175; B41J 2/17546; B41J 2/17566; B41J 2/19
See application file for complete search history.

(56) References Cited

U.S. PATENT DOCUMENTS

| | | | | |
|---|---|---|---|---|
| 2013/0108285 | A1* | 5/2013 | Spink ..... | G03G 15/502 399/24 |
| 2015/0174893 | A1 | 6/2015 | Telljohann | |
| 2015/0301482 | A1 | 10/2015 | Sandler et al. | |

FOREIGN PATENT DOCUMENTS

| | | |
|---|---|---|
| CN | 104494303 A | 4/2015 |
| EP | 1013440 | 6/2000 |
| EP | 1497130 | 8/2006 |
| WO | WO-2016/128566 | 8/2016 |

* cited by examiner

TRANSFERRING PRINT AGENT IN PRINT APPARATUS

BACKGROUND

In some printing systems, print agent may be dissolved into a solvent to form a print solution which may be used as ink in the printing system to be printed onto a substrate (such as a sheet paper).

In some examples, the print agent may be stored in a canister or receptacle until it is to be used. When a print agent canister nears an empty state, it may be replaced by a new print agent canister. However, some print agent may be left inside the canister and may be disposed of and wasted.

BRIEF DESCRIPTION OF DRAWINGS

Examples will now be described, by way of non-limiting example, with reference to the accompanying drawings, in which.

DETAILED DESCRIPTION

A print apparatus may be used to deposit ink onto a substrate or print medium, such as a sheet of paper, in a pattern in accordance with a print instruction. In some printing systems, for example liquid electrophotography (LEP) printing systems, ink may be deposited onto a roller and transferred onto the print medium. In such example systems, the ink to be used may be a solution including a solvent, such as imaging oil (sometimes called base oil), and a solute, such as print agent.

Figure 1:
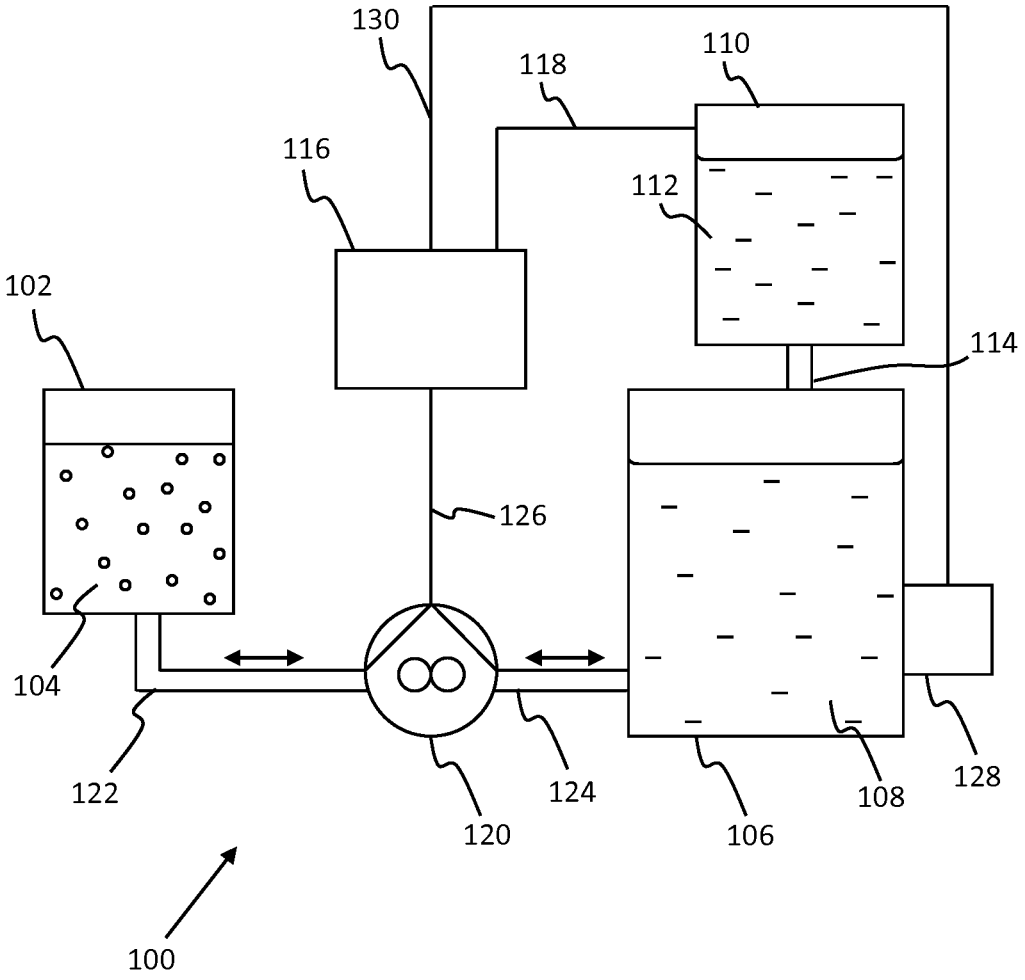
FIG. 1 is a schematic of an example of a print apparatus.

FIG. 1 shows, schematically, components of an example print apparatus 100. The print apparatus 100 includes a print agent reservoir 102 to store print agent 104. The print agent reservoir 102 may, in some examples, be a canister, vessel, hopper or other container, such as a can or a tube, which contains the print agent 104 until the print agent is to be used. The print agent reservoir, or container 102, may be removable from the print apparatus 100, such that, when the amount of print agent 104 in the container 102 falls below a defined level or threshold, a user or operator may remove the container from the print apparatus and replace it with a new, fuller container.

The print agent 104 may, in some examples, be a powder, a liquid or a gel. For example, the print agent may be a solid powder material 104 which may be stored in the container 102. In some examples, the print agent may be a solid ink, or toner. The print apparatus 100 also includes a print solution reservoir 106 (such as container, vessel or tank), to store print solution 108. The print solution 108 may be a solution of print agent 104 dissolved into a print fluid or solvent. In some examples, the solvent may comprise an oil, such as imaging oil. In some examples, the print solution reservoir 106 may be in fluid communication with a solvent reservoir 110 for storing print solution solvent 112. The solvent 112, for example imaging oil, may flow into the print solution reservoir 106 via a solvent conduit 114. The print apparatus 100 may further include a processing apparatus 116, such as a processor or control unit. The processing apparatus 116 may be connected to the solvent reservoir 110, for example by a control line 118, and may control the flow of imaging oil 112 into the print solution reservoir 106. For example, the processing apparatus 116 may cause imaging oil 112 to flow into the print solution reservoir 106 when an amount (e.g. a volume or a level) of print solution 108 in the print solution reservoir falls below a defined level.

The print apparatus 100 may further comprise a pump 120 (or other transfer apparatus) which, in some examples, may be a gear pump. The pump 120 may be in fluid communication with the print agent reservoir 102 via a first pump conduit 122, and in fluid communication with the print solution reservoir 106 via a second pump conduit 124. The pump 120 may be controlled by the processing apparatus 116 via a pump control line 126.

According to some examples, a sensor 128 may associated with the print solution reservoir 106. The sensor 128 may be an optical density sensor (ODS), and may be located within, on, near to, or remote from the print solution reservoir 106. The sensor 128 may be associated with the print solution reservoir 106 such that a parameter of the print solution 108 within the reservoir 106 may be analysed by the sensor. The sensor 128 may, in some examples, measure a density of print agent 104 within the print solution 108 in the print solution reservoir 106. The sensor 128 may be operated and/controlled by the processing apparatus 116, for example via a sensor control line 130.

In examples in which the sensor 128 comprises an optical density sensor, print solution 108 may pass between two lenses (not shown) of the sensor, and light from a light source (not shown) of the sensor may be directed through both lenses and through the print solution passing between the lenses. A detector, such as a photodetector (not shown), of the sensor may measure the amount of the light from the light source that passes through the lenses and the print solution. Some of the light may be absorbed by the print agent 104, and the amount of light absorbed may depend at least in part on the amount, or density, of print agent dissolved within the print solution 108. Thus, a print solution 108 having a relatively higher density of print agent 104 dissolved therein may transmit a relatively smaller proportion of light than a print solution having a relatively lower density of print agent dissolved therein.

In operation, print solution 108 from the print solution reservoir 106 may be transferred to a print medium, for example via a roller (not shown). As noted above, as the level of print solution 108 in the print solution reservoir 106 reduces, solvent 112 may be fed into the print solution reservoir. A particular intended colour of print solution 108 may be formed from particular proportions of print agent 104 and solvent 112. Thus, if solvent 112 is added to the print solution reservoir 106, print agent 104 may also be added to maintain the intended density (and therefore the intended colour). The sensor 128 may monitor the density of print agent 104 in the print solution 108, for example continuously or at intervals during use. A signal may be generated (for example by the processing apparatus 116) if sensor 128 detects that the density of print agent 104 has fallen below a first defined threshold. For example, in some scenarios, it may be intended that the print solution 108 includes a target density of print agent 104 of around 2% percentage of non-volatile solids (% NVS). If the sensor 128 detects that the density of print agent 104 has fallen below 2% NVS, to, say, 1.8% NVS (for example because solvent 112 has been added to the print solution 108) then the processing apparatus 116 may operate the pump 120 to pump print agent 104 from the print agent reservoir 102 into the print solution reservoir 108, to increase the density of print agent.

In some examples, the amount of print agent 104 in the print agent reservoir 102 may fall to below a defined level or threshold, for example the level at which the pump 120 is able to transfer print agent from the print agent reservoir into the print solution 108. In such examples, the sensor 128 may detect that the density of print agent 104 in the print solution 108 continues to fall despite the pump 120 being activated to transfer more print agent into the print solution. If the sensor 128 detects that the density of print agent 104 in the print solution 108 has fallen below a second defined threshold, for example below 1.5% NVS, then it may be determined (e.g. by the processing apparatus 116) that an insufficient amount of print agent remains in the print agent reservoir 102 and that, therefore, the print agent reservoir is almost empty and ought to soon be replaced.

Upon determining that the print agent reservoir 102 is almost empty, the processing apparatus 116 may, in some examples, cause the pump 120 to reverse its pumping direction in order to pump an amount of print solution 108 from the print solution reservoir 106 via the second pump conduit 124 and the first pump conduit 122, into the print agent reservoir 102. The pump 120 may, in some examples, be caused to pump print solution 108 from the print solution reservoir 106 into the print agent reservoir 102 for a defined duration, such as 10 seconds, while, in other examples, the pump may be caused to pump a defined volume of print solution from the print solution reservoir into the print agent reservoir.

While the pump 120 is pumping print solution 108 into the print agent reservoir 102, the print solution may, in some examples, be caused to circulate around the print agent reservoir, thereby rinsing or washing print agent 104 that may have gathered at the bottom of the print agent reservoir, or that may have become stuck to walls of the reservoir 102. Such residual print agent 104 may not be removed by the action of the pump 120 alone, but may be dissolved into the print solution circulating around the print agent reservoir 102, forming a rinse solution.

After rinse solution has been circulated around the print agent reservoir 102 for the defined duration, or after a defined volume of print solution has been pumped into and circulated around the print agent reservoir, the processing apparatus 116 may instruct the pump 120, or otherwise cause the pump, to reverse its pumping direction so that the rinse solution (i.e. an amount of print solution 108 which has been circulated around the print agent reservoir 102 and into which residual print agent may be have been dissolved) is pumped through the first and second pump conduits 122, 124 into the print solution reservoir 106.

In some examples, a user or operator may be informed that the print agent reservoir is empty (or nearly empty) and, therefore, may be replaced. In some examples, the processing apparatus 116 may provide such an indication to the user. The user may be informed via a visual indicator, such as a display screen or an indicator light, and/or via an audible indicator, such as a speaker. In some examples, the indication to the user is made after the rinse solution has been pumped from the print agent reservoir 102. In other examples, the indication may be made to the use before the rinse solution is pumped from the print agent reservoir. The pumping of print solution or solvent into the print agent reservoir 102, and the pumping of the rinse solution from the print agent reservoir into the print solution reservoir 106 may be performed while the printing apparatus is in use (e.g. performing a print job) and, therefore, utilization time of the printing apparatus may not be interrupted.

Figure 2:
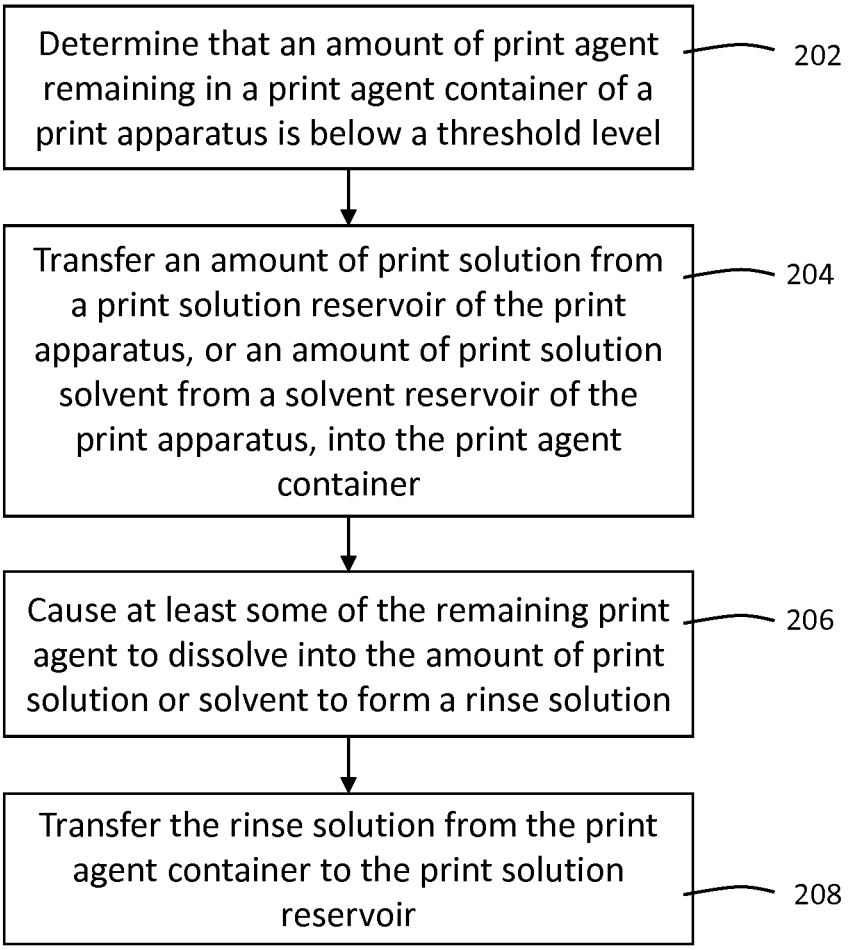
FIG. 2 is a flowchart of an example method of extracting print agent in a print apparatus.

FIG. 2 is a flowchart showing an example method of extracting print agent in a print apparatus. The method may comprise, at block 202, determining that an amount of print agent 104 remaining in a print agent container 102 of a print apparatus is below a threshold level. As noted above, such a determination may be made using the sensor 128 which may, in some examples, detect when the density of print agent 104 in the print solution 108 is below a threshold level even though a pump (such as the pump 120) is attempting to transfer more print agent into the print solution.

In some examples, the method may comprise, at block 204, transferring an amount of print solution 108 from a print solution reservoir 106 of the print apparatus, or an amount of print solution solvent 112 from a solvent reservoir 110 of the print apparatus, into the print agent container 102. In some examples, the amount of print solution 108 to be transferred, for example using the pump 120, may be based on a defined volume. In other examples, the pump 120 may be activated for a defined duration to cause a particular amount of print solution 108 to be transferred.

The method may comprise, at block 206, causing at least some of the remaining print agent 104 to dissolve into the amount of print solution 108 or print solution solvent 112 to form a rinse solution. The remaining print agent may be residual print agent that has adhered to an inner wall the print agent container 102. The causing of block 206 may in some examples, comprise causing said amount of print solution or print solution solvent to circulate within the print agent container for a defined duration At block 208, the method may comprise transferring the rinse solution from the print agent container 102 to the print solution reservoir 106. By rinsing, or flushing, the print agent container 102 with an amount of print solution, residual print agent 104 which might otherwise be left in the print agent container 102, and therefore wasted, may be extracted from the container 102 and used. Therefore, the amount of print agent that is wasted may be reduced. In some examples, the transferring (block 208) and the causing (block 206) are effected by a single pump.

Figure 3:
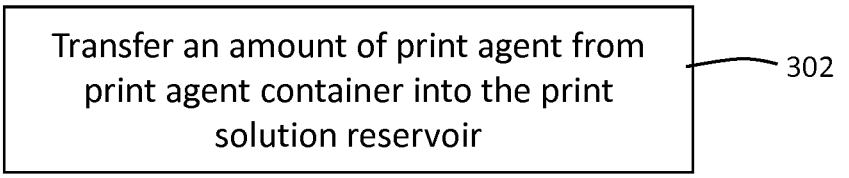
FIG. 3 is a flowchart of an example method of extracting print agent in a print apparatus.

FIG. 3 is a block of a flowchart of an example method of extracting print agent in a print apparatus. Prior to said determining (block 202 of FIG. 2), the method may comprise, at block 302, transferring an amount of print agent 104 from the print agent container 102 into the print solution reservoir 106. As discussed above, the transfer of print agent 104 into the print solution reservoir 106 may be caused by the pump 120, for example in response to a determination that the density of print agent 104 in the print solution 108 in the print solution reservoir 106 has fallen to, or below, a defined threshold.

Figure 4:
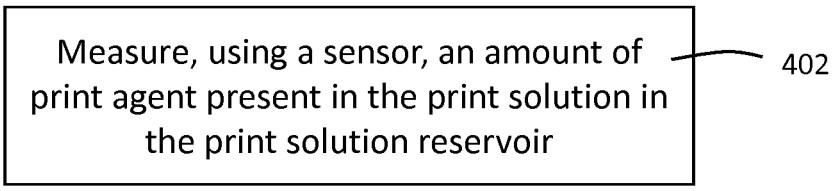
FIG. 4 is a flowchart of an example method of extracting print agent in a print apparatus.

A further block of a flowchart of an example method of extracting print agent in a print apparatus is shown in FIG. 4. Prior to said determining (block 202 of FIG. 2), the method may comprise, at block 402, measuring, using a sensor 128, an amount of print agent 104 present in the print solution 108 in the print solution reservoir 106. As noted above, the sensor 128 may, in some examples, comprise an optical density sensor. In some examples, the sensor 128 may be located within the print solution reservoir 106. The measurement made by the sensor 128 may be used to determine, for example by the processing apparatus 116, that the density of print agent 104 in the print solution 108 in the print solution reservoir 106 has fallen to, or below, a defined threshold.

Figure 5:
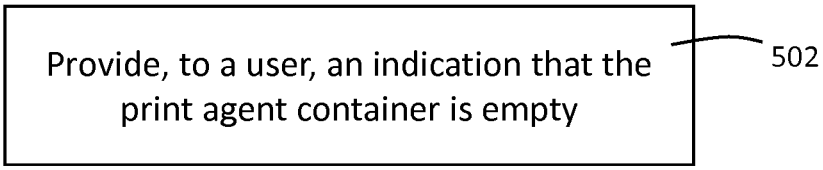
FIG. 5 is a flowchart of an example method of extracting print agent in a print apparatus.

FIG. 5 is a block of a flowchart of an example method of extracting print agent in a print apparatus. At block 502, the method may comprise providing, to a user, an indication that the print agent container 102 is empty. In some examples, the indication may be provided after the rinse solution has been transferred to the print solution reservoir 106. In other examples, the indication may be provided before the rinse solution has been transferred to the print solution reservoir 106. Said indication may be made, for example, using a display screen, or an indicator light, and may prompt the user, or an operator, to remove the empty (or nearly empty) print agent container 102 and replace the container with a full container.

Figure 6:
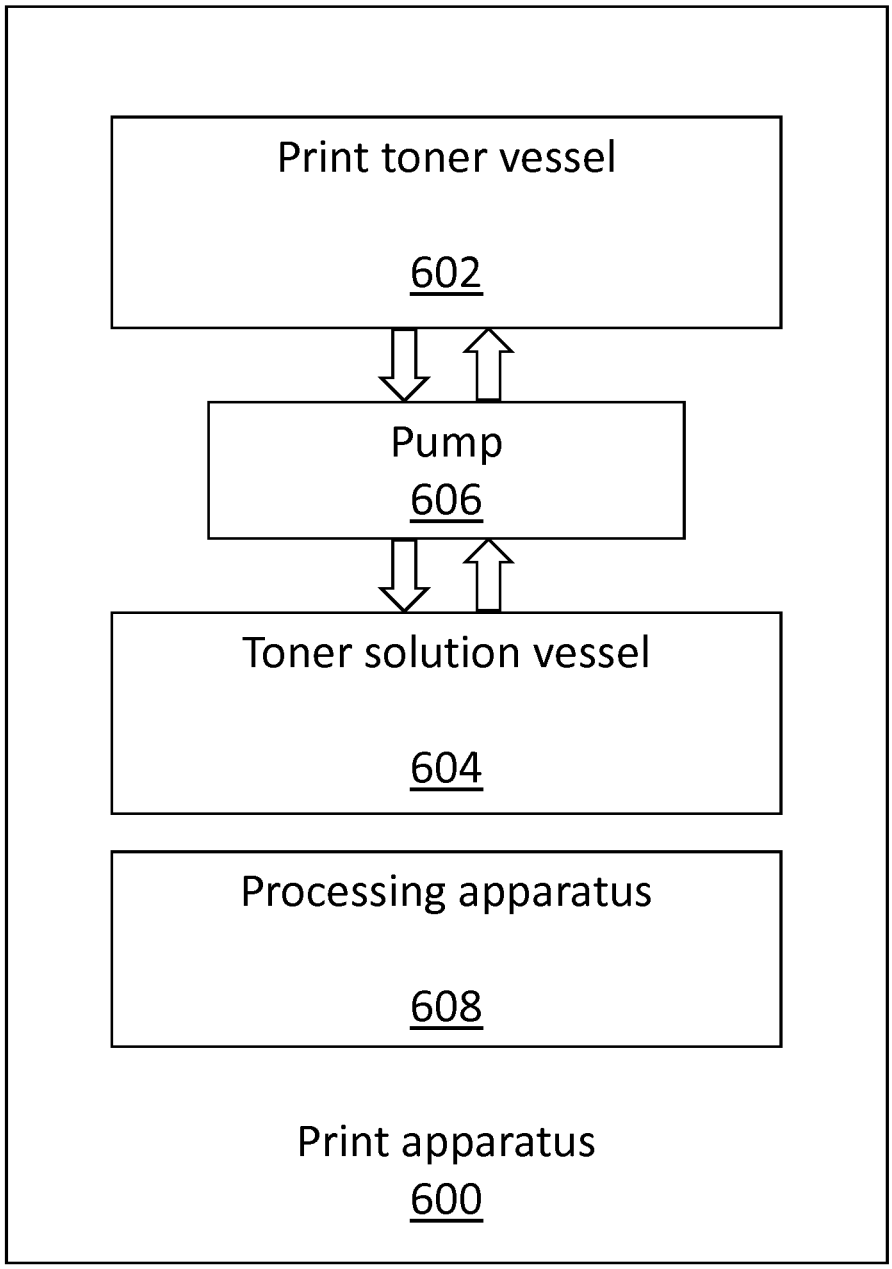
FIG. 6 is a schematic of an example of a print apparatus.

A schematic of an example of a print apparatus 600 is shown in FIG. 6. The print apparatus 600 may be the print apparatus 100 of FIG. 1. According to some examples, the print apparatus 600 may comprise a print toner vessel 602 to hold print toner. The print toner may, in some examples, comprise the print agent 104 of FIG. 1.

The print apparatus 600 may comprise a toner solution vessel 604 to hold a toner solution of print toner and a print fluid. In some examples, the toner solution may comprise the print solution 108 of FIG. 1, and the print fluid may comprise the solvent 112 of FIG. 1.

The print apparatus may, in some examples, comprise a pump 606 to pump print toner from the print toner vessel 602 into the toner solution vessel 604. The pump 606 may, in some examples, comprise a gear pump.

According to some examples, the print apparatus may comprise a processing apparatus 608. The processing apparatus 608 may determine that a level of print toner remaining in the print toner vessel 602 is below a threshold level. As noted above, such a determination may be made by determining that a density of print toner in the print toner solution is below a defined threshold, and this may be indicative that there is insufficient print toner in the print toner vessel 602 to be transferred by the pump 606 into the toner solution vessel 604 to achieve the intended density.

The processing apparatus 608 may, in some examples, control the pump 606 to pump an amount of print fluid or toner solution from the toner solution vessel 604 into the print toner vessel 602 to dissolve at least some of the remaining print toner into the amount of print fluid or toner solution. Some print toner may be dissolved into the amount of toner solution as the toner solution is pumped into the print toner vessel 602. In some examples, the pump 606 may cause the toner solution to rinse, or wash around the print toner vessel 602 so as to cause more of the print toner to dissolve into the toner solution.

In some examples, the processing apparatus 608 may control the pump to pump at least some of the print fluid or toner solution from the print toner vessel 602 into the toner solution vessel 604. Thus, after some of the residual print toner from the print toner vessel 602 has been dissolved into the toner solution, the toner solution may be pumped into the toner solution vessel 604, where it may be used in a printing operation.

While the processing apparatus 608 may be located in the print apparatus 600, as is described above, the processing apparatus may, in some examples, be located outside, or remote from, the print apparatus, for example in a computing device or server (not shown) associated with, and connected to (e.g. via a wired or wireless connection) to the print apparatus.

Figure 7:
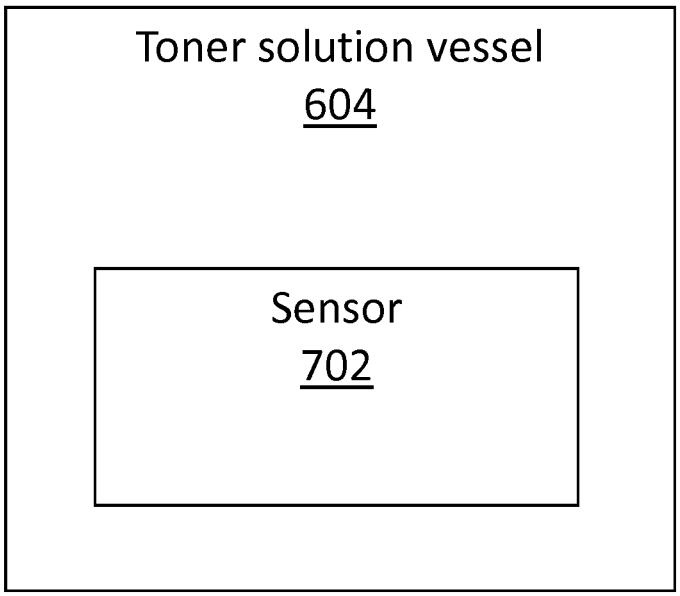
FIG. 7 is a schematic of an example of a portion of a print apparatus.

FIG. 7 is a schematic of an example of a portion of the print apparatus 600. FIG. 7 shows the toner solution vessel 604. In some examples, the print apparatus 600 or the toner solution vessel 604 may comprise a sensor 702 (such as the sensor 128 of FIG. 1) to measure a proportion of print toner present in the toner solution in the toner solution vessel 604. In some examples, the sensor 702 may be located within the toner solution vessel 604 while, in other examples, the sensor may be associated with the toner solution vessel, but located elsewhere on the print apparatus 600. The sensor 702 may, in some examples, be an optical density sensor and/or may measure a density of print toner in the toner solution in the toner solution vessel 604. Data obtained by the sensor 702 may be used, for example by the processing apparatus 608, to determine a corresponding amount of print toner remaining in the print toner vessel 602. Thus, in some examples, the processing apparatus 608 may use the measurement obtained by the sensor 702 to determine that the level of print toner remaining in the print toner vessel 602 is below said threshold level.

In some examples, the print toner (the print agent 104) may comprise concentrated powdered ink. The print toner may, in some examples, comprise electrically-reactive ink, or a component thereof. Such ink may be used in a liquid electrophotography (LEP) printing apparatus. The print fluid (the solvent 112) may, in some examples, comprise an imaging oil. The electrically-reactive ink may be formed by dissolving the print toner in the print fluid.

Figure 8:
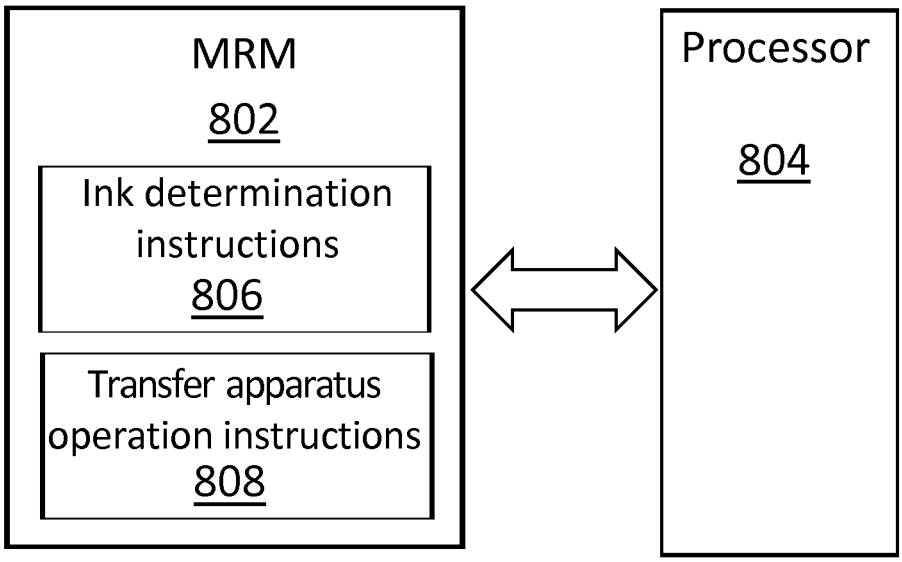
FIG. 8 is a schematic of an example machine readable medium with a processor.

A schematic of an example machine readable medium with a processor is shown in FIG. 8. The machine-readable medium 802 comprises ink determination instructions 806 which, when executed by the processor 804, cause the processor 804 to determine that an amount of ink present in an ink hopper of a print apparatus is below a threshold amount. The machine-readable medium 802 further comprises transfer apparatus operation instructions 808 which, when executed by the processor 804, cause the processor to operate a transfer apparatus (such as, for example, the pump 120, 606) to convey a proportion of ink solution from an ink solution tank of the print apparatus, or solvent from a solvent reservoir of the print apparatus, into the ink hopper, thereby to dissolve at least some of the ink present in the ink hopper into the proportion of ink solution or solvent to form an ink mixture. The transfer operation instructions 808, when executed by the processor 804, further cause the processor 804 to operate the transfer apparatus to convey the ink mixture from the ink hopper into the ink solution tank.

In some examples, the machine-readable medium 802 may comprise instructions which, when executed by the processor 804, cause the processor 804 to operate the transfer apparatus to circulate the proportion of ink solution or solvent within the ink hopper for a defined duration. Such circulation may cause more ink from the ink hopper to dissolve into the ink solution.

In some examples, the machine-readable medium 802 may comprise instructions which, when executed by the processor 804, cause the processor 804 to provide, to a user, an indication that the print agent container is empty.

In some examples of the present disclosure, rather than pumping an amount of print solution 108 from the print solution reservoir 106, 604 into the print agent reservoir 102, 602 (block 204 of FIG. 2), an amount of solvent 112 may be transferred (for example by the pump 120, 606) from the solvent reservoir 110 into the print agent reservoir to form a rinse solution/mixture. The rinse solution may then be pumped into the print solution reservoir 106, 604.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

measuring, using a sensor, an amount of print agent present in print solution in a print solution reservoir of a print apparatus;

after said measuring, determining that an amount of print agent remaining in a print agent container of the print apparatus is below a threshold level;

transferring an amount of print solution from the print solution reservoir, or an amount of solvent from a solvent reservoir of the print apparatus, into the print agent container;

causing at least some of the remaining print agent to dissolve into the amount of print solution or solvent to form a rinse solution; and transferring the rinse solution from the print agent container to the print solution reservoir.

2. A method according to claim 1, further comprising, prior to said determining:

transferring an amount of print agent from the print agent container into the print solution reservoir.

3. A method according to claim 1, wherein said causing comprises:

causing said amount of print solution or solvent to circulate within the print agent container for a defined duration.

4. A method according to claim 1, wherein said transferring and said causing are effected by a single pump.

5. A method according to claim 1, further comprising:

providing, to a user, an indication that the print agent container is empty.

6. A print apparatus comprising:

a print toner vessel to hold print toner;

a toner solution vessel to hold a toner solution of print toner and a print fluid;

a sensor to measure a proportion of print toner present in the toner solution in the toner solution vessel;

a pump to pump print toner from the print toner vessel into the toner solution vessel; and processing apparatus to:

determine that a level of print toner remaining in the print toner vessel is below a threshold level;

control the pump to pump an amount of print fluid or toner solution from the toner solution vessel into the print toner vessel to dissolve at least some of the remaining print toner into the amount of print fluid or toner solution; and control the pump to pump at least some of the print fluid or toner solution from the print toner vessel into the toner solution vessel.

7. A print apparatus according to claim 6, wherein the processing apparatus uses the measurement obtained by the sensor to determine that the level of print toner remaining in the print toner vessel is below said threshold level.

8. A print apparatus according to claim 6, wherein the sensor comprises an optical density sensor.

9. A print apparatus according to claim 6, wherein the print toner comprises concentrated powdered ink.

10. A print apparatus according to claim 6, wherein the print fluid comprises an imaging oil.

11. A machine-readable medium comprising instructions which, when executed by a processor, cause the processor to:

measure, using a sensor, an amount of ink present in print solution in a print solution reservoir;

after said measuring, determine that an amount of ink present in an ink hopper of a print apparatus is below a threshold amount;

operate a transfer apparatus to convey a proportion of ink solution from an ink solution tank of the print apparatus, or solvent from a solvent reservoir of the print apparatus, into the ink hopper, thereby to dissolve at least some of the ink present in the ink hopper into the proportion of ink solution or solvent to form an ink mixture; and operate the transfer apparatus to convey the ink mixture from the ink hopper into the ink solution tank.

12. A machine-readable medium according to claim 11, further comprising instructions which, when executed by a processor, cause the processor to:

operate the transfer apparatus to circulate the proportion of ink solution or solvent within the ink hopper for a defined duration.

13. A machine-readable medium according to claim 11, further comprising instructions which, when executed by a processor, cause the processor to:

provide, to a user, an indication that the print agent container is empty.

* * * * *